US006196030B1

(12) United States Patent
Stoll et al.

(10) Patent No.: US 6,196,030 B1
(45) Date of Patent: Mar. 6, 2001

(54) KNIT ARTICLE HAVING SEVERAL SPATIALLY OVERLAPPING STRUCTURES MADE IN A CONTINUOUS KNITTING PROCESS

(75) Inventors: Thomas Stoll, Reutlingen; Wolfgang Rempp, Gammertingen; Hansmartin Schwarz, Nuertingen, all of (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/159,159

(22) Filed: Sep. 23, 1998

(30) Foreign Application Priority Data

Sep. 30, 1997 (DE) ..... 197 43 074

(51) Int. Cl.[7] ..... D04B 1/26
(52) U.S. Cl. ..... 66/178 R; 66/189
(58) Field of Search ..... 66/171, 175, 176, 66/177, 178 R–182, 183–189, 184, 185, 186, 187, 60 R, 64–67, 70, 76, 77

(56) References Cited

U.S. PATENT DOCUMENTS 3,975,929 * 8/1976 Fregeolle ..... 602/63
4,027,667 * 6/1977 Swallow et al. ..... 602/63
4,038,699 * 8/1977 Burn ..... 2/239
4,923,724 5/1990 Day et al. .
5,226,297 7/1993 Manini .
5,419,161 5/1995 Bodenschatz et al. .
5,444,995 * 8/1995 Benetton ..... 66/64
5,519,894 * 5/1996 Imboden et al. ..... 2/409
5,722,262 * 3/1998 Proctor et al. ..... 66/60 R
5,737,943 4/1998 Bernhardt .
5,749,247 * 5/1998 Jeffcoat ..... 66/198
5,787,512 * 8/1998 Knox ..... 2/409

FOREIGN PATENT DOCUMENTS 789902 2/1973 (BE) .
196 05 002 A1 8/1997 (DE) .
91/15620 10/1991 (WO) .

* cited by examiner

*Primary Examiner*—Danny Worrell
(74) *Attorney, Agent, or Firm*—Michael J. Striker

(57) ABSTRACT

The knit article is provided with several spatially overlapping structures. It is made by a continuous knitting process on a knitting machine with at least two opposing needle beds (H,V) as a seamless tubular manufactured product.

15 Claims, 4 Drawing Sheets

KNIT ARTICLE HAVING SEVERAL SPATIALLY OVERLAPPING STRUCTURES MADE IN A CONTINUOUS KNITTING PROCESS

BACKGROUND OF THE INVENTION

Three-dimensional knit products with comparatively expensive structure, such as stockings, are currently made from several knit or cut segments that are combined with each other by sewing or stitching at their edges. Various other working steps continuously follow the process of sewing or stitching the individual segments together, which consequently cause additional costs.

Summary of the Invention

It is an object of the present invention to provide an improved knit article or article of clothing that reduces the undesirable effects of the above-described disadvantages.

According to the invention the knit article has several spatially overlapping structures and is made in a continuous knitting process on a knitting machine with at least two opposing needle beds as a seamless tubular manufactured product. Scarcely any additional working steps are necessary with this knit product. The knit product can, for example, be a hosiery product, or stockings, but it can also be a medical or orthopedic device, such as support hose or a kneecap. Also knit engineering products, such as tubular T-joint elements and protective clothing made from aramide thread material, are within the scope of the present invention. The knit product can be adjusted to the desired spatial geometry by a uniform distribution of loop rows of different width and/or take-up operations, such as narrowing or covering, and/or by a variation in loop size. Nearly any predetermined spatial structure may be formed by this method, without forming a seam or weak place in the knit article. The knit article can have at least one region with a definite cross elasticity, which is formed by binding weft thread in the knit article. The manufacture of the knit article with reinforced regions is possible by knitting a reinforcing thread into it. The knit article can also have at least one stiffened region, which is formed by knitting a pile structure into it. Furthermore the knit article can be provided with at least one opening in its surface, for example for a zipper or fasteners, or also at least one pocket-like structure. Individual regions of the knit article can also be made from a thread material of high absorptivity or other specific properties. The knit pattern and the interweaving type may be of any arbitrary type.

BRIEF DESCRIPTION OF THE DRAWING

The objects, features and advantages of the present invention will be explained in more detail by the following examples with reference to the drawing, in which.

DESCRIPTION OF THE PREFERRED EMBODIMENTS

Figure 1:
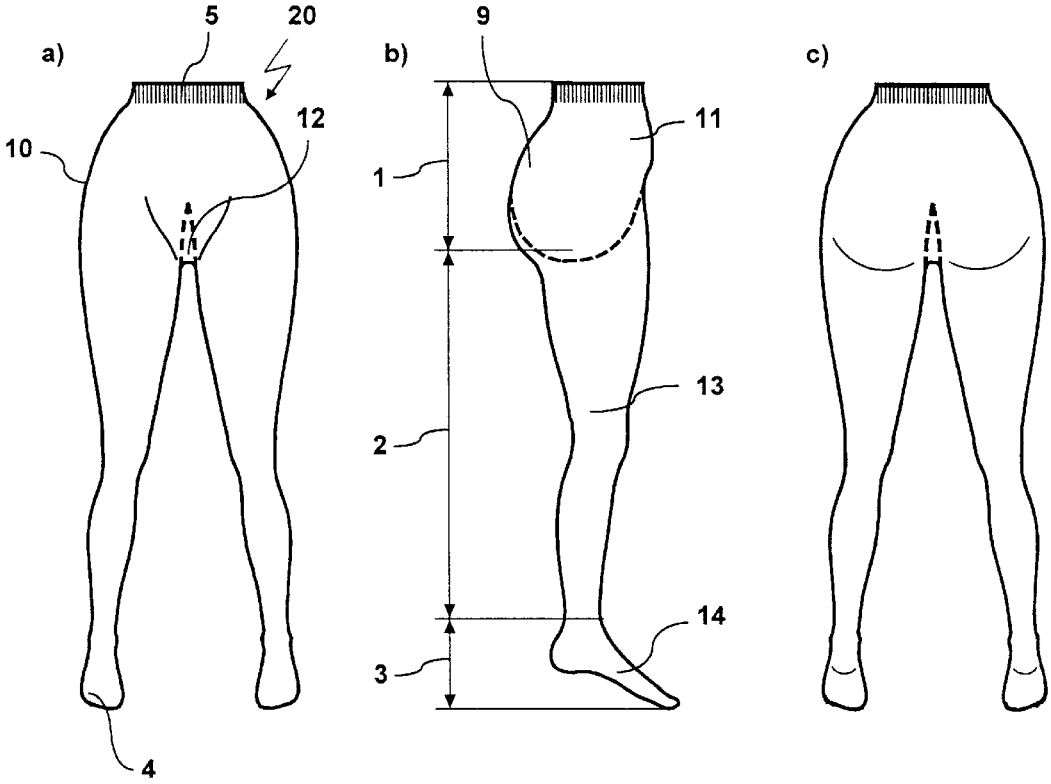
FIGS. 1*a*, 1*b* and 1*c* are respective front, side and rear views of a hosiery article according to the invention.
Figure 2:
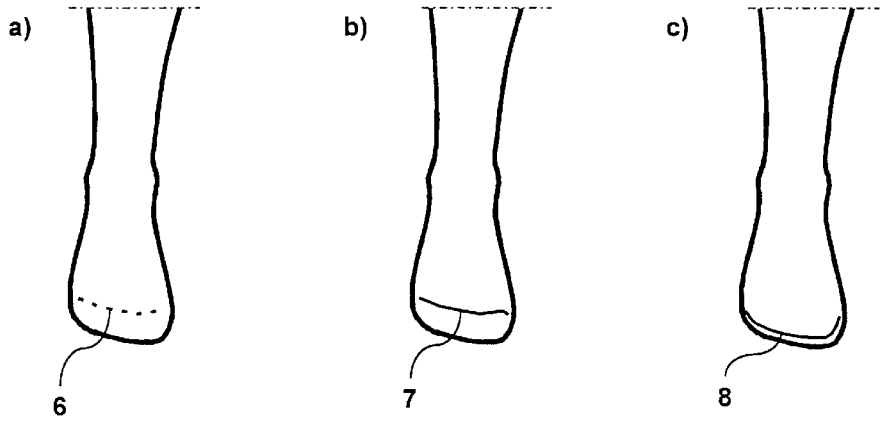
FIGS. 2*a*, 2*b* and 2*c* are respective plan views of different embodiments of a foot region of the hosiery article shown in FIGS. 1*a*, 1*b* and 1*c*.

The hosiery article 20 of FIGS. 1*a* to 1*c* comprises a body region 1, a leg region 2 and a foot region 3. All of these regions are essentially spatial, tubular structures that are seamlessly connected with each other. The seat region 9, the hip region 10, the belly region 11, the center region 12, the leg 13 and the foot region 14 can be fit exactly to the body shape by take-up, take-off and spinning techniques. The stitching or looping for that can be started both in the foot caps 4 and the waist band 5. When the foot cap 4 is started, the waist band can be formed with any conceivable stitching or looping method. The band may be finished for example by means of looping or stitching techniques. When the looping is started in the band, the final series of loops or loop row is located on the underside 6, the upper side 7 of the front side 8 of the foot cap 4. The hosiery article 20 can also be strengthened in the body region 1 and for example in the region of the heel and the foot cap 4. Also strengthening or reinforcing threads can be stitched into these regions. If the hosiery article also fulfills a support function, it can be provided with an exact predetermined elasticity by introducing suitable weft threads in the individual regions. Inclusion of absorptive regions is possible by using a bulk or volumetric stitching technique and suitable thread materials. Of course not only complete hosiery articles may be made in this way but also any arbitrary portion between the waist band 5 and the foot cap 4, such as support stockings, hose or medicinal knee caps and the like may be manufactured by this method. Also other knit articles serving generally as clothing and engineering products which may be made by weaving and knitting are included within the scope of the invention.

Figure 3:
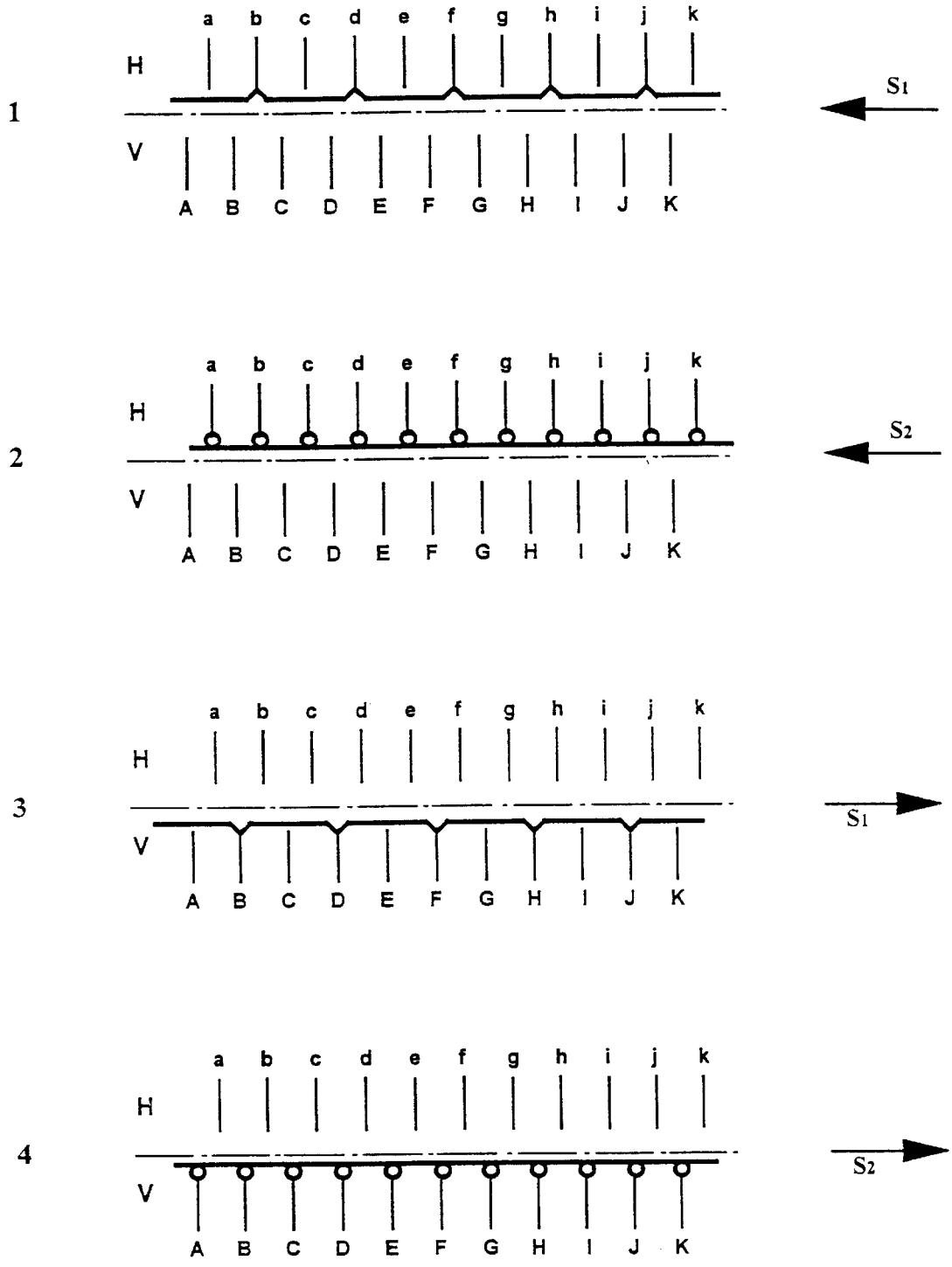
FIG. 3 is a diagrammatic illustration of a looping process for making a knit article with imitation weft threads.

FIG. 3 describes a looping process for imitating introduction of weft thread or yarn to make regions of exactly predetermined elasticity in the knit article of the invention. No special weft threads are used. Furthermore the thread in row 1, which can also be an elastic thread, is taken up by every second needle of the rear needle bed H. Subsequently each needle of the rear needle bed H forms a loop with the thread in row 2, before each second needle of the front needle bed V takes up the thread in row 3. In row 4 a loop is formed in the thread with every needle of the front needle bed V. The predetermined elasticity of the knit product is obtained by the taking of the thread with every second needle of the front and rear needle bed V, H. The hosiery depth determines the length of the thread introduced into it. The longer the thread, the more the knit article stretches. The desired elasticity is thus very accurately established in this way.

Figure 4:
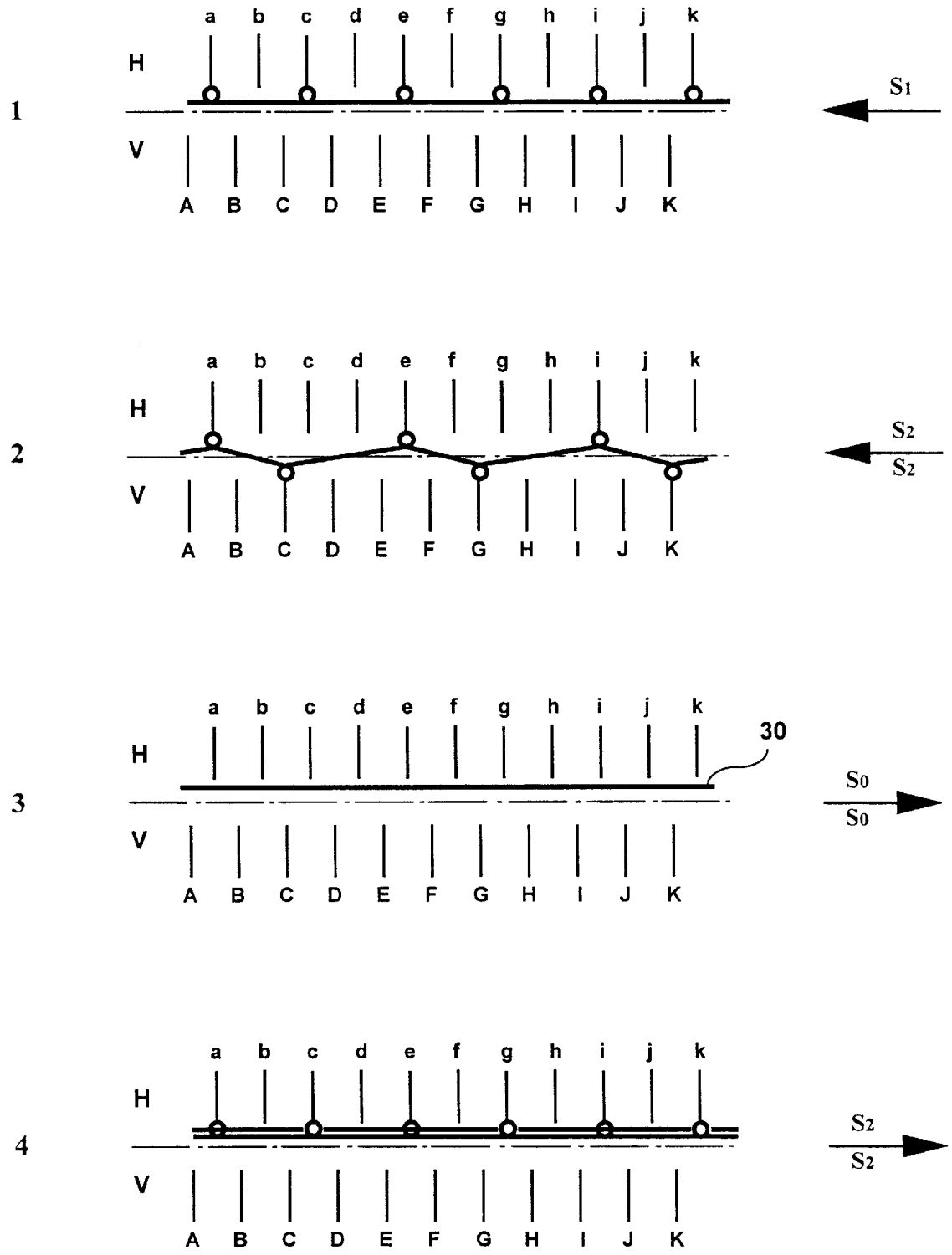
FIG. 4 is a diagrammatic illustration of a looping or stitching process for making a knit article with a weft thread binding technique.

A weft thread binding technique is shown in FIG. 4 with which a desired cross elasticity of the knit article can be obtained. A loop is formed in row 1 with the thread by every second needle of the rear needle bed H. The choice of needles that form the loop depends on the pattern. Subsequently the loops of every second needle of the rear needle bed H are hung on the front needle bed V. In row 3 a weft thread 30, which can advantageously be an elastic thread, is laid over the knit thread. In row 4 those loops which had been hung on the front needle bed V are returned to the originating needles in the rear needle bed H, whereby the weft thread 30 is combined in the knit article.

Figure 5:
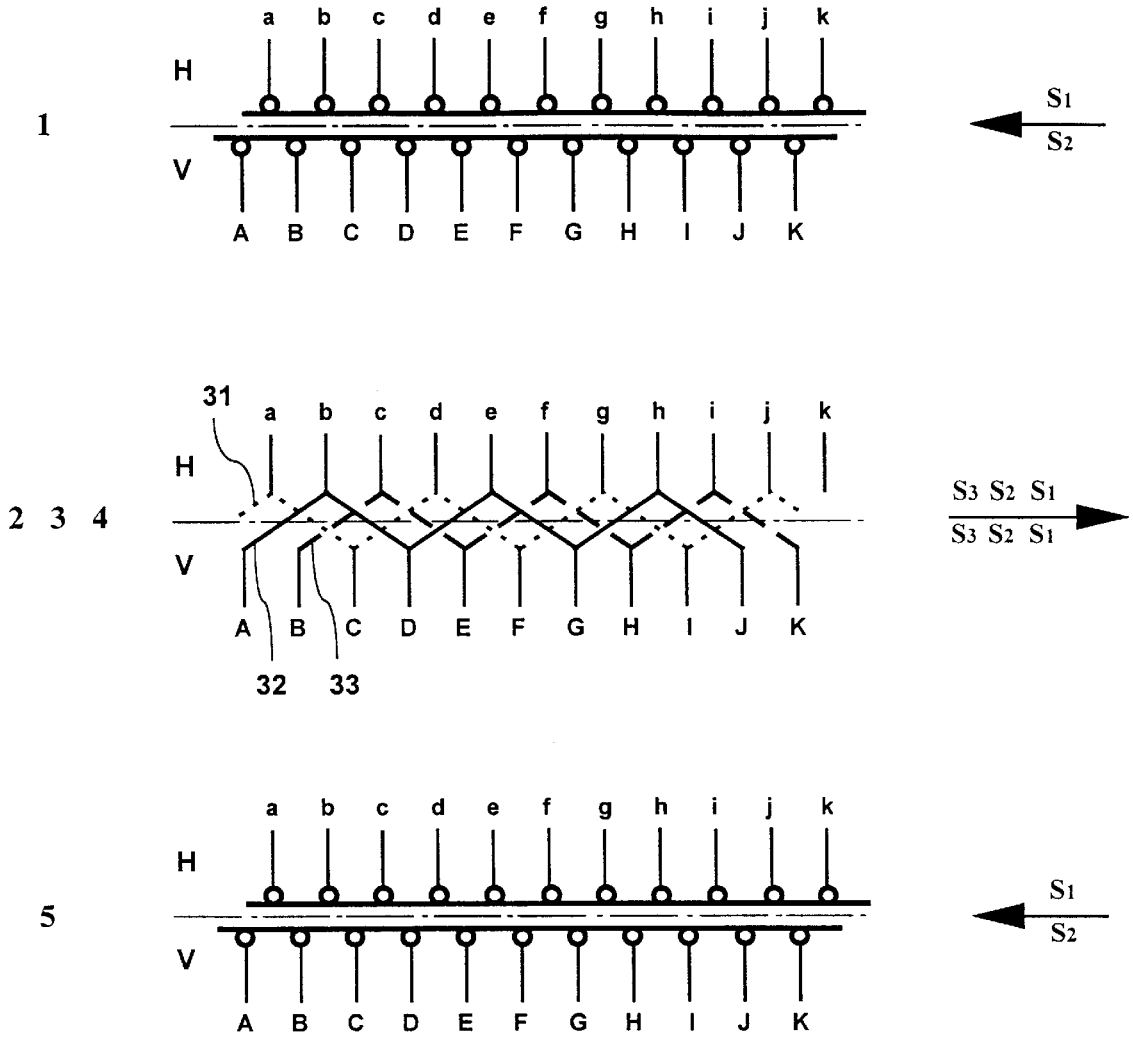
FIG. 5 is a diagrammatic illustration of a stitching process for making a knit article with a pile structure.

FIG. 5 illustrates the production of a pile structure by which the knit article can be stiffened in various regions. In row 1 a smooth or flat stitch is formed with all the needles in the front and rear needle beds V, H. A first, second and third pile thread 31, 32 and 33 are laid in stitching or loops on the rear and front needle beds H, V. Subsequently in row 5 a straight stitch is formed on the front and rear needle beds V, H with all the needles and because of that the pile threads are combined in the knit article.

The present invention is also described in German Patent Application 197 43 074.0 of Sep. 30, 1997, which is incorporated here by reference and forms the basis for a claim of priority under 35 U.S.C. 119 for the appended claims.

While the invention has been illustrated and described as embodied in a knit article having several spatially overlapping structures made in a continuous knitting process, it is not intended to be limited to the details shown, since various modifications and structural changes may be made without departing from the spirit of the present invention.

Without further analysis, the foregoing will so fully reveal the gist of the invention that others can, by applying current knowledge, readily adapt it for various applications without omitting features that, from the standpoint of the prior art, fairly constitute essential characteristics of the generic and specific aspects of the present invention.

What is claimed is new and desired to be protected by Letters Patent is set forth in the appended claims.

We claim:

1. A knit article comprising several spatially overlapping structures, wherein said knit article is made by a continuous knitting process on a knitting machine with at least two opposing needle beds (H,V) as a seamless tubular manufactured product, the knit article having uniformly distributed rows of loops of thread of different width, the knit article having sections with rows having a reduced number of loops and sections with rows having an increased number of loops, a predetermined structure or a predetermined geometry.

2. The knit article as defined in claim 1, wherein said loop include varying loop size.

3. The knit article as defined in claim 1, comprising at least one region of predetermined cross elasticity and said knitting process includes forming said at least one region of predetermined cross elasticity by including weft threads in the knit article.

4. The knit article as defined in claim 1, comprising at least one stiffened region formed by knitting a pile structure into the knit article.

5. The knit article as defined in claim 1, comprising at least one reinforced region formed by knitting reinforcing threads into the knit article.

6. The knit article as defined in claim 1, provided with at least one opening in a surface thereof.

7. The knit article as defined in claim 1, provided with at least one pocket structure.

8. The knit article as defined in claim 1, consisting of clothing.

9. The knit article as defined in claim 8, wherein said clothing is a stocking.

10. The knit article as defined in claim 1, consisting of a medicinal or orthopedic device.

11. The knit article as defined in claim 10, wherein the medicinal or orthopedic device consists of a support stocking or knee cap.

12. The knit article as defined in claim 1, consisting of an engineering device.

13. The knit article as defined in claim 12, wherein the engineering device is a tubular T-joint element.

14. The knit article as defined in claim 1, having an absorptive region having a comparatively higher absorptivity than thread material used in the knitting process.

15. The knit article as defined in claim 1, wherein said knit article, made by said continuous process, is made on a flat knitting machine.

* * * * *